US009145220B2

(12) United States Patent
Mirandola

(10) Patent No.: US 9,145,220 B2
(45) Date of Patent: Sep. 29, 2015

(54) PACKAGING MACHINE FOR INCUBATOR TRAYS

(75) Inventor: Andre Luiz de Aguiar Mirandola, Rinopolis (BR)

(73) Assignee: Nelson Yamasaki (BR)

( * ) Notice: Subject to any disclaimer, the term of this patent is extended or adjusted under 35 U.S.C. 154(b) by 850 days.

(21) Appl. No.: 12/679,092

(22) PCT Filed: Sep. 19, 2008

(86) PCT No.: PCT/BR2008/000288

§ 371 (c)(1),
(2), (4) Date: Apr. 13, 2010

(87) PCT Pub. No.: WO2009/036543

PCT Pub. Date: Mar. 26, 2009

(65) Prior Publication Data

US 2010/0229505 A1 Sep. 16, 2010

(30) Foreign Application Priority Data

Sep. 21, 2007 (BR) ..... 0704924
Aug. 19, 2008 (BR) ..... 8802468 U

(51) Int. Cl.
*B65B 5/00* (2006.01)
*B65B 23/06* (2006.01)

(52) U.S. Cl.
CPC ..... *B65B 23/06* (2013.01)

(58) Field of Classification Search
USPC ..... 53/475, 443, 448, 248, 244, 534, 535, 53/247
See application file for complete search history.

(56) References Cited

U.S. PATENT DOCUMENTS

| | | | | |
|---|---|---|---|---|
| 3,147,738 | A | 9/1964 | Theilig | |
| 3,311,216 | A * | 3/1967 | Jones | 53/497 |
| 3,316,688 | A * | 5/1967 | Niederer et al. | 53/497 |
| 3,722,173 | A * | 3/1973 | Noguchi | 53/500 |
| 4,189,898 | A * | 2/1980 | Moulds et al. | 53/446 |
| 4,575,993 | A | 3/1986 | Meyn | |
| 4,730,440 | A * | 3/1988 | van der Schoot et al. | 53/446 |
| 4,733,518 | A * | 3/1988 | Griesdorn | 53/444 |
| 5,365,717 | A | 11/1994 | McKinlay | |
| 5,457,933 | A * | 10/1995 | LaVars et al. | 53/247 |
| 5,575,134 | A * | 11/1996 | Main | 53/443 |
| 7,900,426 | B2 * | 3/2011 | Stenbom | 53/475 |

FOREIGN PATENT DOCUMENTS

EP 0560458 9/1993

* cited by examiner

*Primary Examiner* — Sameh Tawfik
(74) *Attorney, Agent, or Firm* — Schmeiser, Olsen & Watts, LLP

(57) ABSTRACT

The present invention discloses a novel construction arrangement in a packaging machine for incubator trays, which enables the general automation of the packaging process of eggs in incubator trays. The packaging machine for incubator trays accepts several arrangements and capacity for four, five, six and twelve eggs, depending on the incubator trays to be used. The packaging machine for incubator trays of the present invention exhibits great improvements. One of these great improvements is related to the introduction of an automatic feeder for trays, commonly called tray dispenser or denester for incubator trays. Another great improvement refers to a constructive change in one of the main elements of the disclosed machine, and this change was made in order to stop vibrations that the eggs were eventually exposed. The benefits obtained from the use of the packaging machine for incubator trays, the main object of this invention, are related to the possibility of greater automation of the process. In addition, the transport of eggs occurs in a more secure and constant way, decreasing the number of broken and/or damaged eggs.

6 Claims, 10 Drawing Sheets

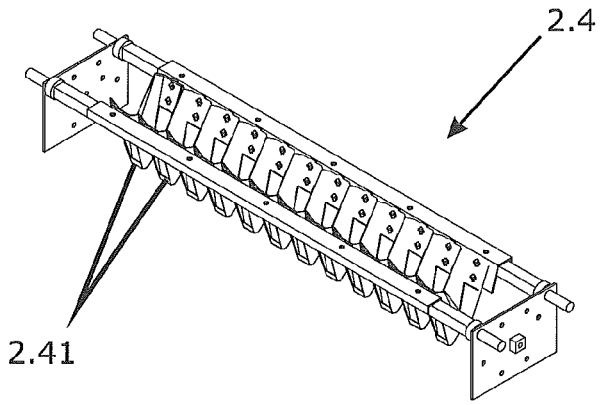
FIGURE 8.1
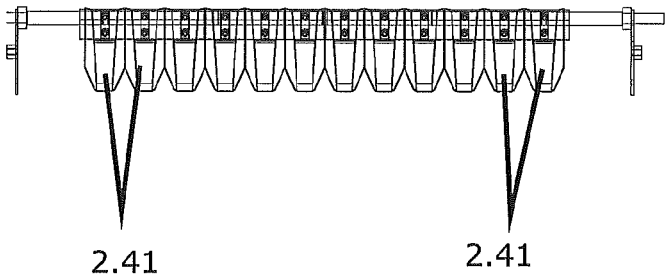
FIGURE 8.2
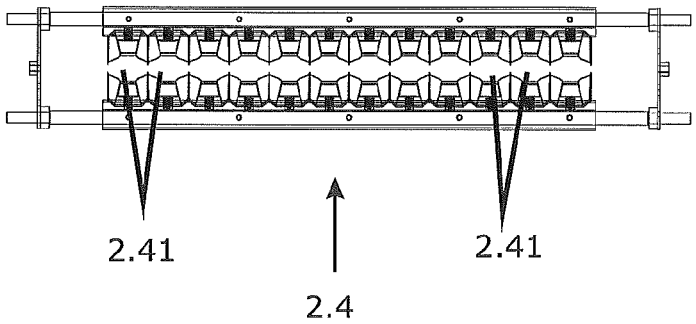
FIGURE 8.3

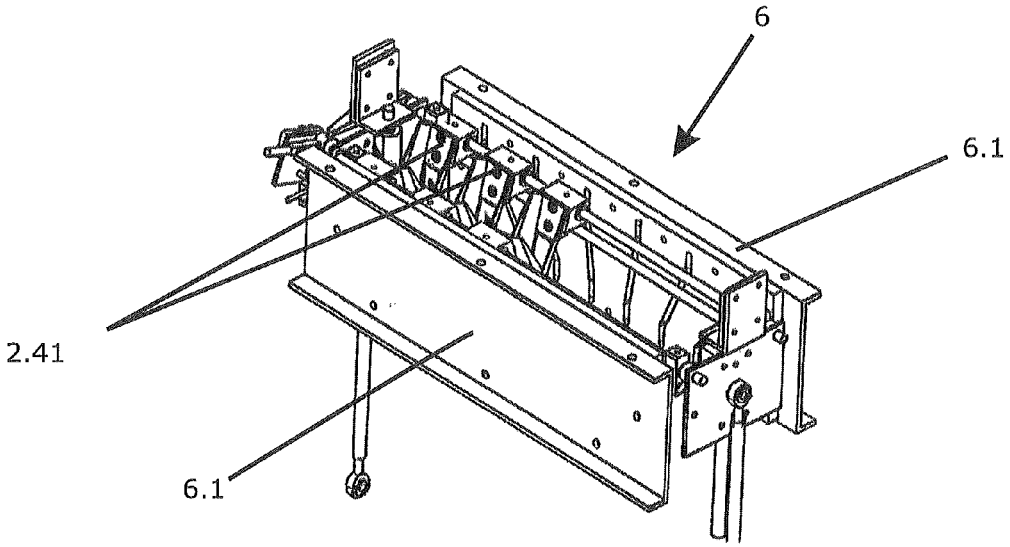
FIGURE 9.1
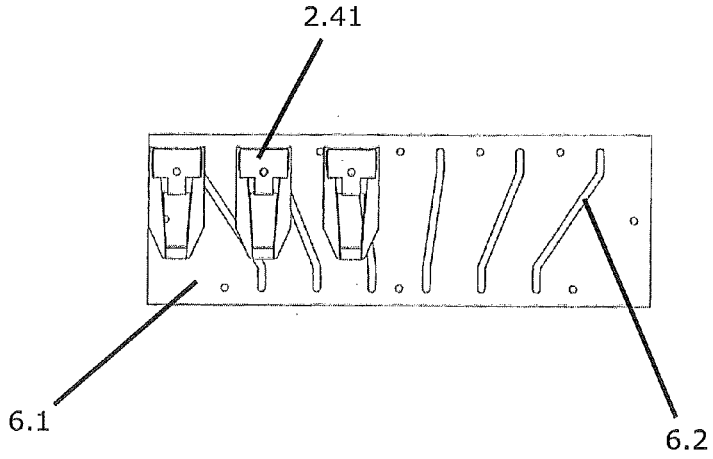
FIGURE 9.2

PACKAGING MACHINE FOR INCUBATOR TRAYS

FIELD OF THE INVENTION

The present invention discloses a novel construction arrangement in a packaging machine for incubator trays, which enables the general automation of the packaging process of eggs in incubator trays. The packaging machine provided by the present invention is attachable to ovoscopy machines in general.

BACKGROUND OF THE INVENTION

Incubator trays are, as the name implies, trays designed for packaging of eggs to be incubated.

Unlike the consumption egg trays, an incubator tray has to keep each egg in a substantially fixed position. Therefore, said incubator trays have substantially deep cavities for the packaging of eggs. It is also important to emphasize that incubator trays have several arrangements and housing units for eggs. Said arrangements can be vertically or horizontally aligned or can be shifted in a vertically or horizontally oriented zigzag form.

Conventionally, incubator trays are filled, that is, supplied with eggs, but manually and not automatically. In these cases, eggs from a machine or from an ovoscopy system are sent to a conventional conveyor belt, where positioned operators perform the task of carrying manually the eggs from the conveyor belt to the incubator trays.

This type of procedure is extremely undesirable for many reasons, and among them, the most relevant reason refers to the fact that operators have manual contact with eggs, and this factor causes a variety of related negative factors, mainly, hygiene and sterility of the process.

SUMMARY OF THE INVENTION

The present invention was developed in order to overcome these and other drawbacks of the prior art by providing a packaging machine for incubator trays.

The packaging machine for incubator trays, the main object of the present invention, has several arrangements and capacity for different quantities of eggs, comprising lines of eggs with from 4, 5, 6 to 12 eggs, depending on the type of incubator tray to be used.

The packaging machine for incubator trays of the present invention exhibits great improvements. One of these great improvements is related to the introduction of an automatic feeder for trays, commonly called tray dispenser or denester for incubator trays.

Another great improvement refers to a constructive change in one of the main elements of the disclosed machine, and this change was made in order to stop vibrations that the eggs were eventually exposed.

The benefits obtained from the use of the packaging machine for incubator trays, the main object of this invention, are related to the possibility of greater automation of the process. In addition, the transport of eggs occurs in a more secure and constant way, decreasing the number of broken and/or damaged eggs.

BRIEF DESCRIPTION OF THE DRAWINGS

The present invention will be now described in detail based on the schematic figures, wherein:

FIG. 8.1 is a perspective view illustrating an enlarged detail of the egg receiving structure, according to the present invention;

FIG. 8.2 is a front view illustrating an enlarged detail of the egg receiving structure, according to the present invention;

FIG. 8.3 is a top view illustrating an enlarged detail of the egg receiving structure, according to the present invention;

FIG. 9.1 illustrates an enlarged detail of an alternative operating mode of the egg receiving structure, according to the present invention;

FIG. 9.2 illustrates an enlarged detail of the inner face of one of the walls that compose the alternative operating mode of the egg receiver structure, according to the present invention, and;

DETAILED DESCRIPTION OF THE INVENTION

Figure 1:
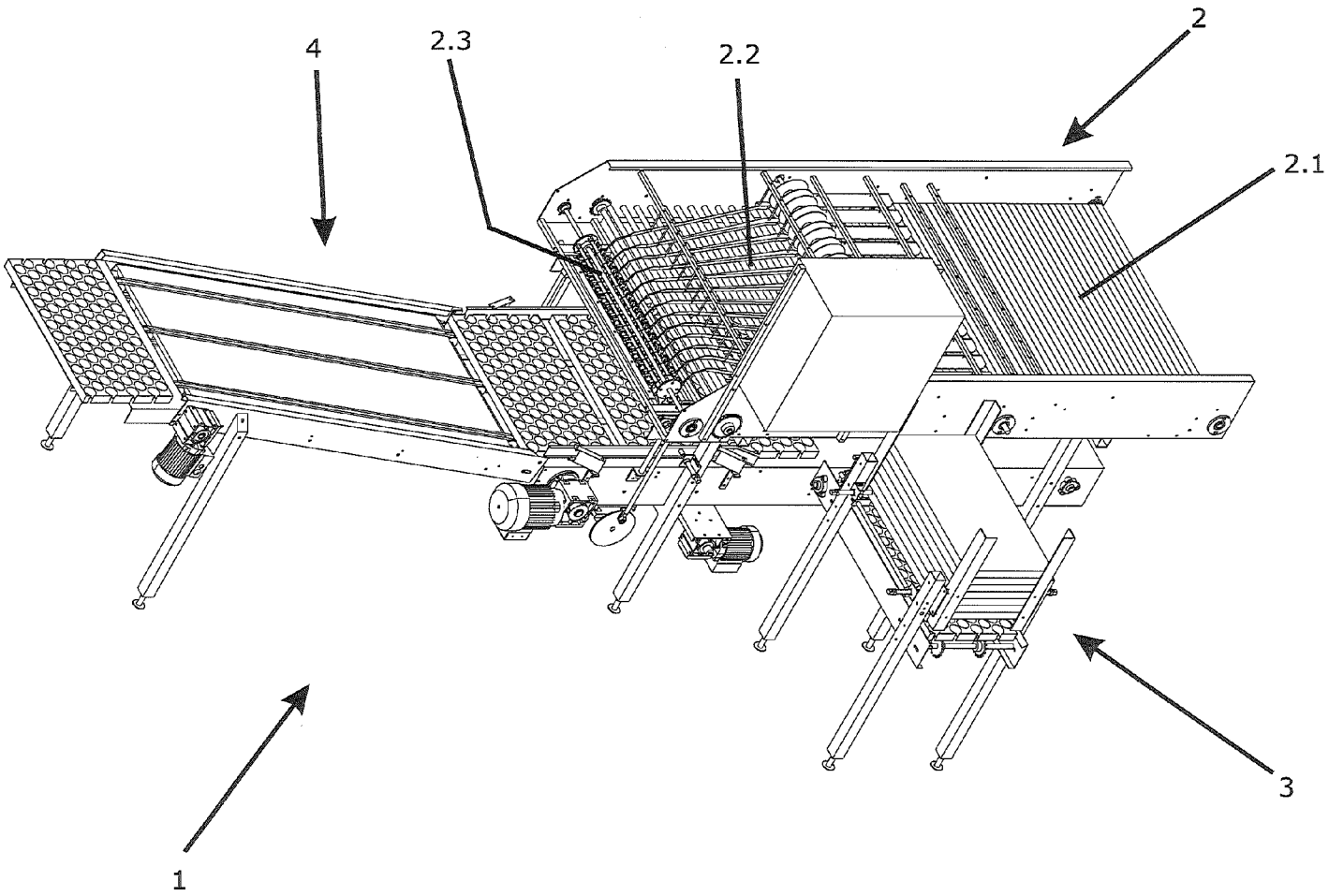
FIG. 1 is a perspective view illustrating the packaging machine for incubator trays, according to the present invention.
Figure 2:
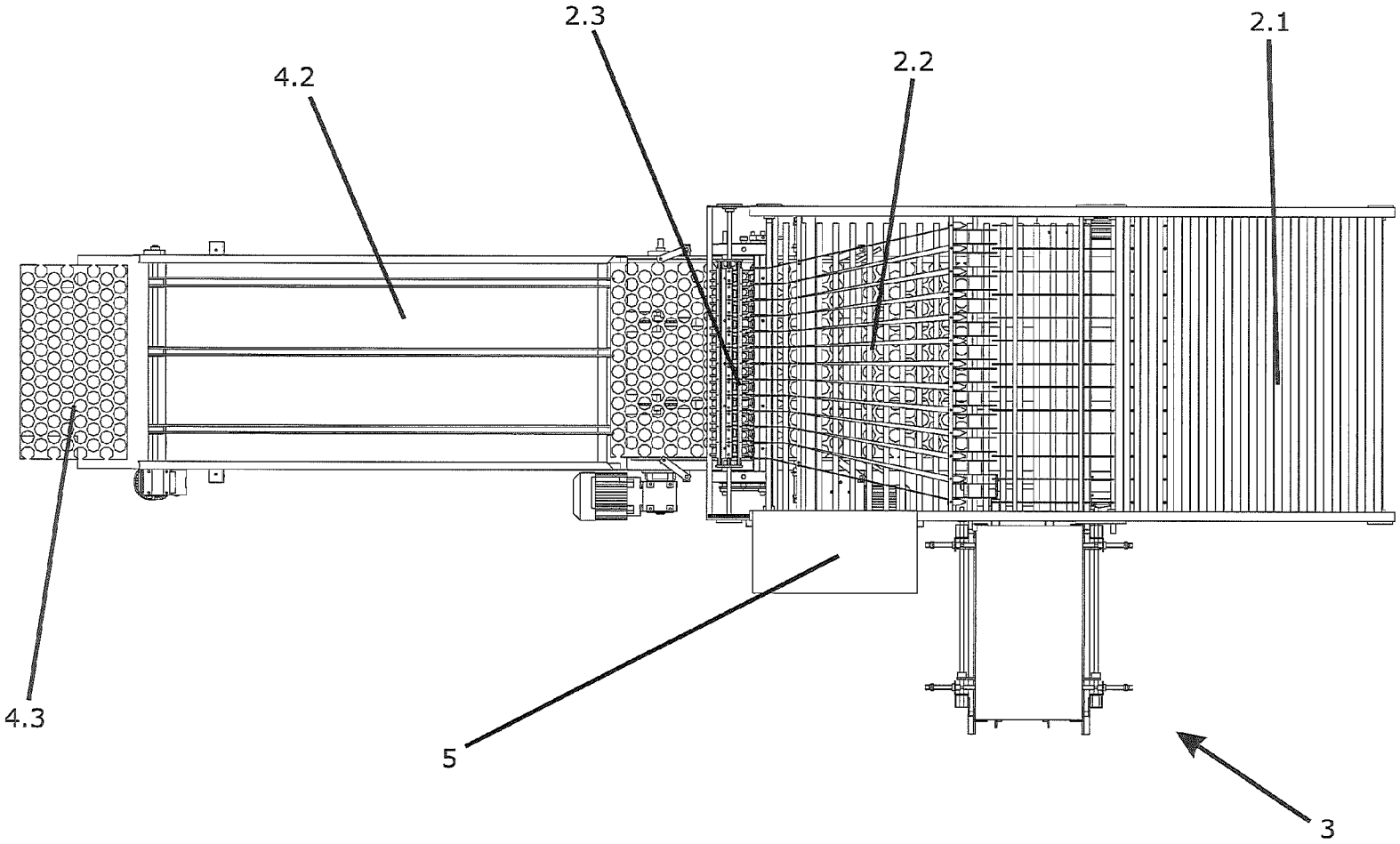
FIG. 2 is a top view illustrating the packaging machine for incubator trays, according to the present invention.
Figure 3:
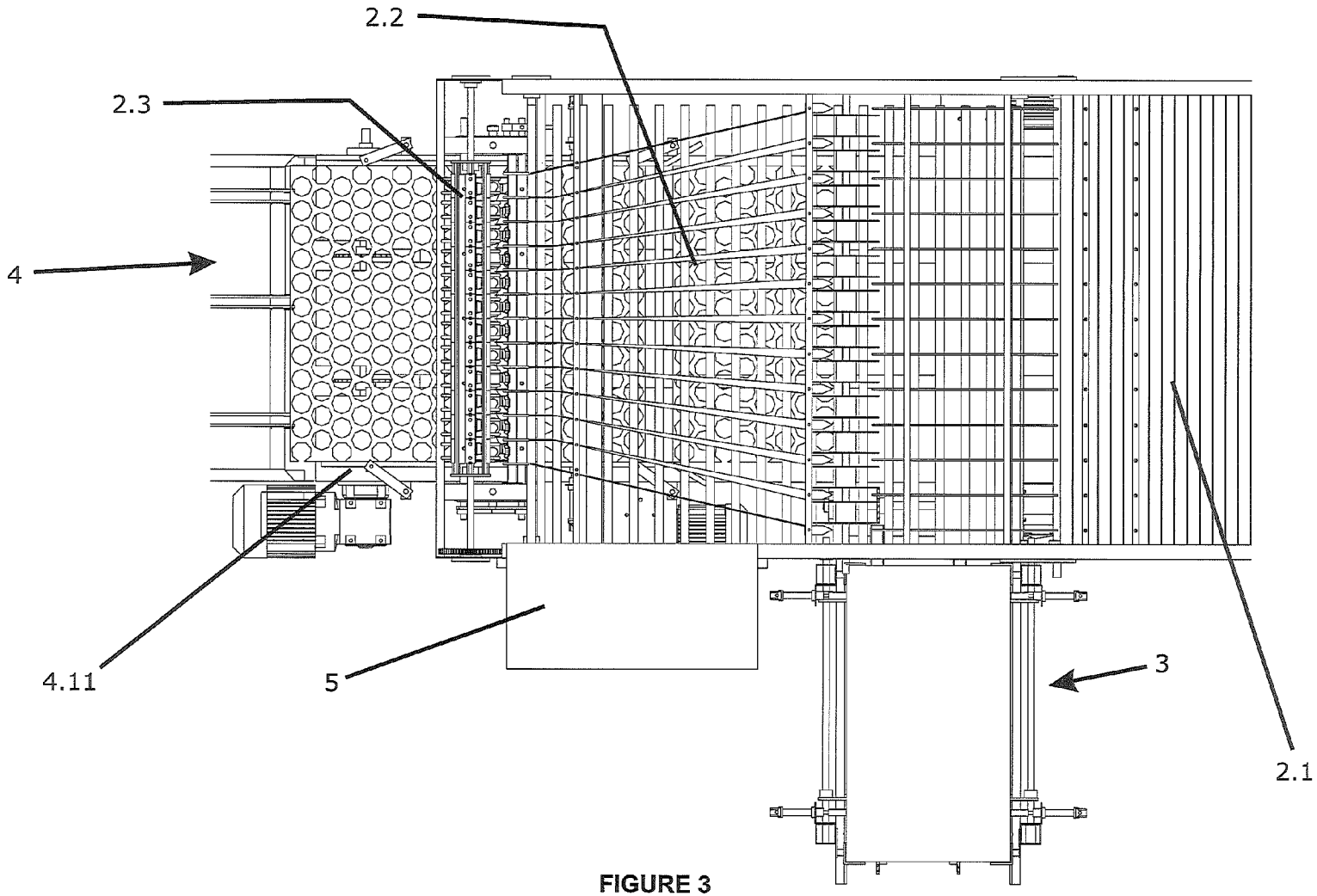
FIG. 3 shows an enlarged detail of FIG. 2, according to the present invention.
Figure 4:
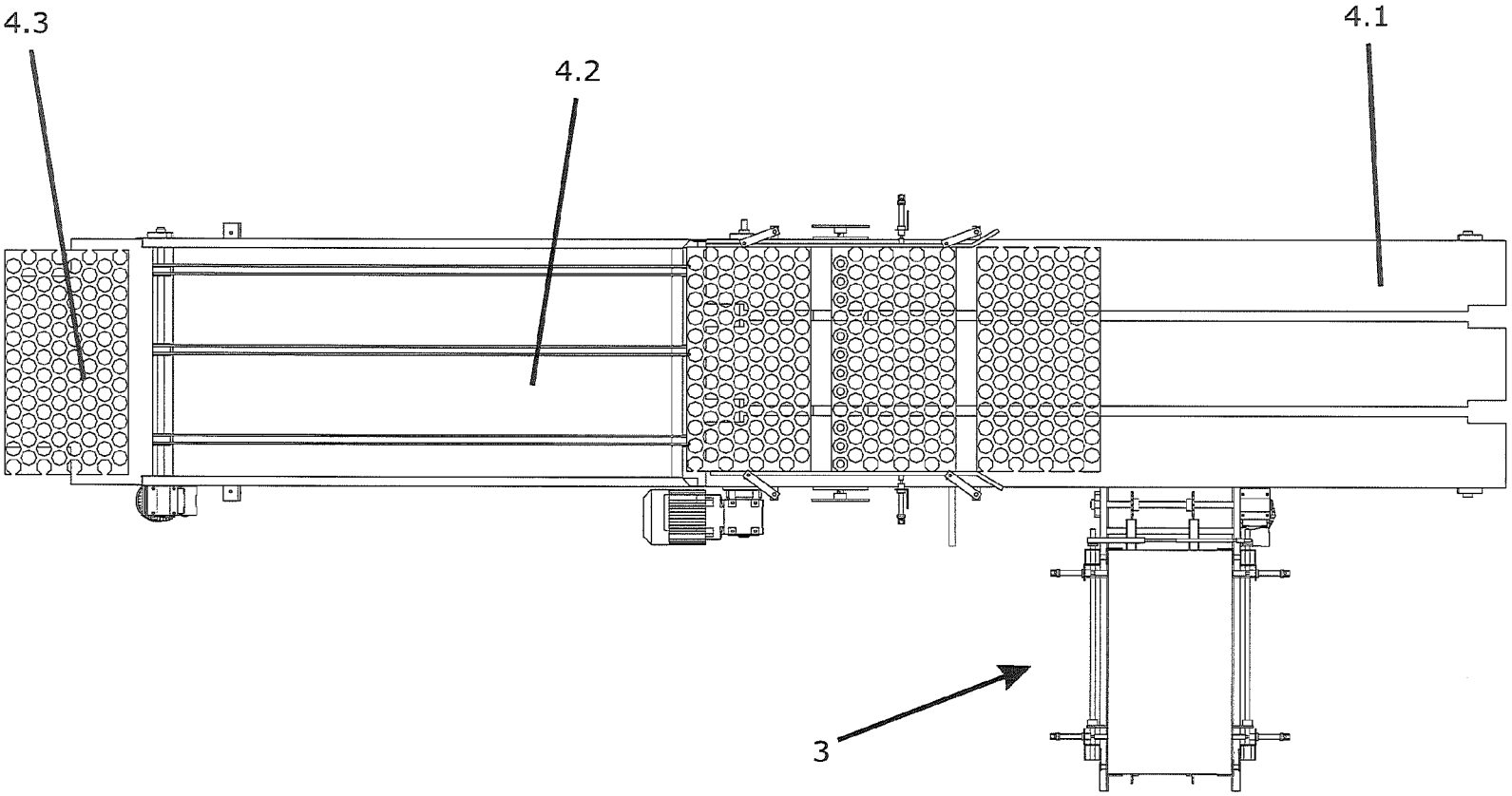
FIG. 4 is a top view illustrating the packaging machine for incubator trays without its upper module, according to the present invention.
Figure 5:
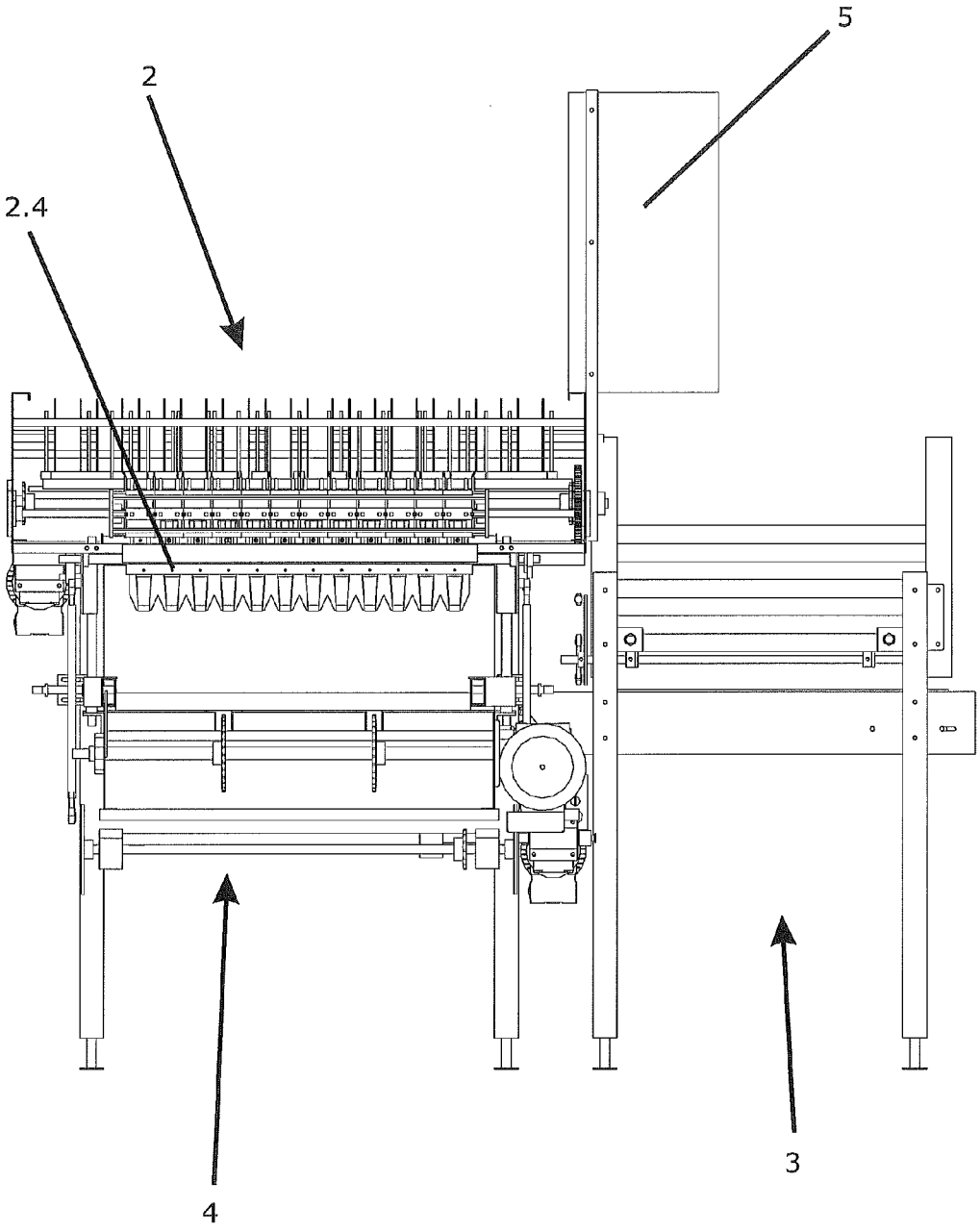
FIG. 5 is a front view illustrating the packaging machine for incubator trays, according to the present invention.

Based on the FIGS. 1, 2, 3, 4, 5, 6, 7, 8.1, 8.2, 8.3, 9.1, and 9.2, it is possible to observe that the packaging machine for incubator trays, hereinafter referred as packaging machine (1), basically comprises a upper module (2), a intermediary module (3) and a lower module (4). It is important to emphasize that the packaging machine (1) is responsible for receiving eggs from an egg classifier machine, where said eggs are classified by predetermined weight, by using a mechanical or electronic scale, disposing eggs turned upside down, and finally, the packaging machine (1) deposit eggs directly into incubator egg trays.

Alternatively, the packaging machine (1) can also be used to receive eggs from the aviary through an egg-receiving belt, and package eggs in incubator trays, in order to be transported to the egg classifier machine. Although, in this case, after the transport of incubator trays to the egg classifier machine, a feeder is also used to catch the eggs directly from the incubator tray used for the transport, thus feeding the egg classifier machine.

In relation to its construction features, the upper module (2) comprises basically a conveyor belt (2.1), an egg horizontal driver (2.2), a driver cylinder (2.3) and an egg receiver structure (2.4).

The conveyor belt (2.1) is a conventional conveyor belt located between the egg horizontal driver (2.2) and any ovoscopy system (not shown).

The egg horizontal driver (2.2), which is located between the conveyor belt (2.1) and the driver cylinder (2.3), is a series of driver elements mounted on rotating cylinders.

The driver cylinder (2.3) is a cylinder equipped with multiple concentrically arranged stems, which are also aligned in relation to the egg horizontal driver (2.2).

The driver cylinder (2.3), which is located at the end of the egg horizontal driver (2.2), is fixed to the carcass of the upper module (2) through a shaft.

The egg receiver structure (2.4), which comprises a set of receiver cups (2.41), is located just below the span between the egg horizontal driver (2.2) and the driver cylinder (2.3). Moreover, the egg receiver structure (2.4) has vertical displacement.

It is also important to mention that the multiple receiver cups (2.41) have axial openings. The number of receiver cups (2.41) existing in an egg receiver structure (2.4) will vary according to the productive capacity of the packaging machine (1).

The operation of the upper module (2) is simple. The eggs from a machine or from any ovoscopy system (not shown) go to the conveyor belt (2.1). From the conveyor belt (2.1), said eggs go to the egg horizontal driver (2.2), and at its end, said eggs are assisted by the driver cylinder (2.3) to move down, exactly where the egg receiver structure (2.4) is positioned. The function of the egg receiver structure (2.4) is to carry the eggs from the upper module (2) to the lower module (4).

The intermediary module (3) comprises, basically, a feeder module of incubator trays. This module is a structure provided with driver jigs (3.1), and a conveyor belt (3.2), which is powered by one or more electric motors (3.3). Several incubator trays (3.4) are arranged one above the other.

It is also important to emphasize that the intermediary module (3) is provided with pneumatic actuators (3.5), which are responsible for the timing of the operation of the intermediary module (3) with the upper module (2).

Figure 6:
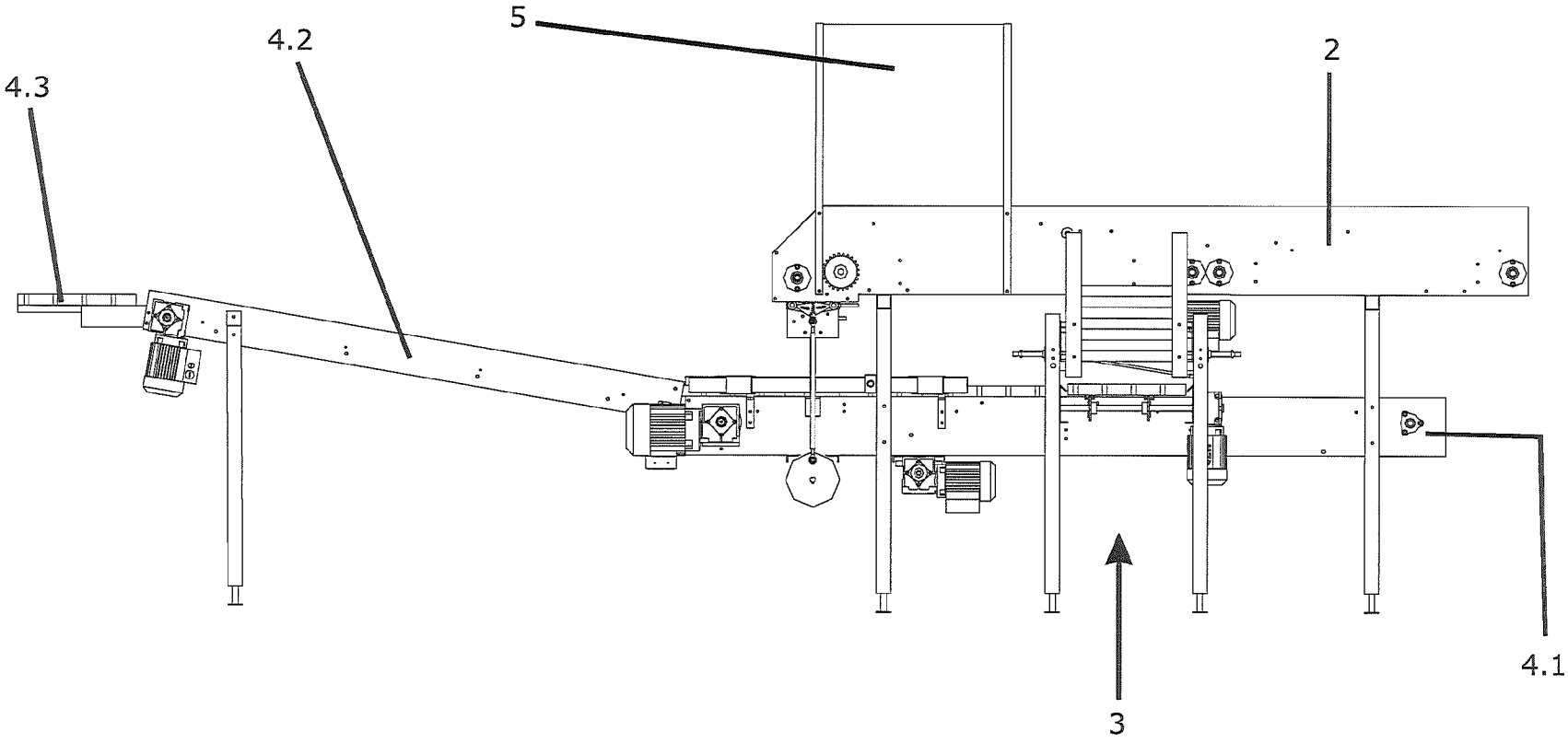
FIG. 6 is a side view illustrating the packaging machine for incubator trays, according to the present invention.
Figure 7:
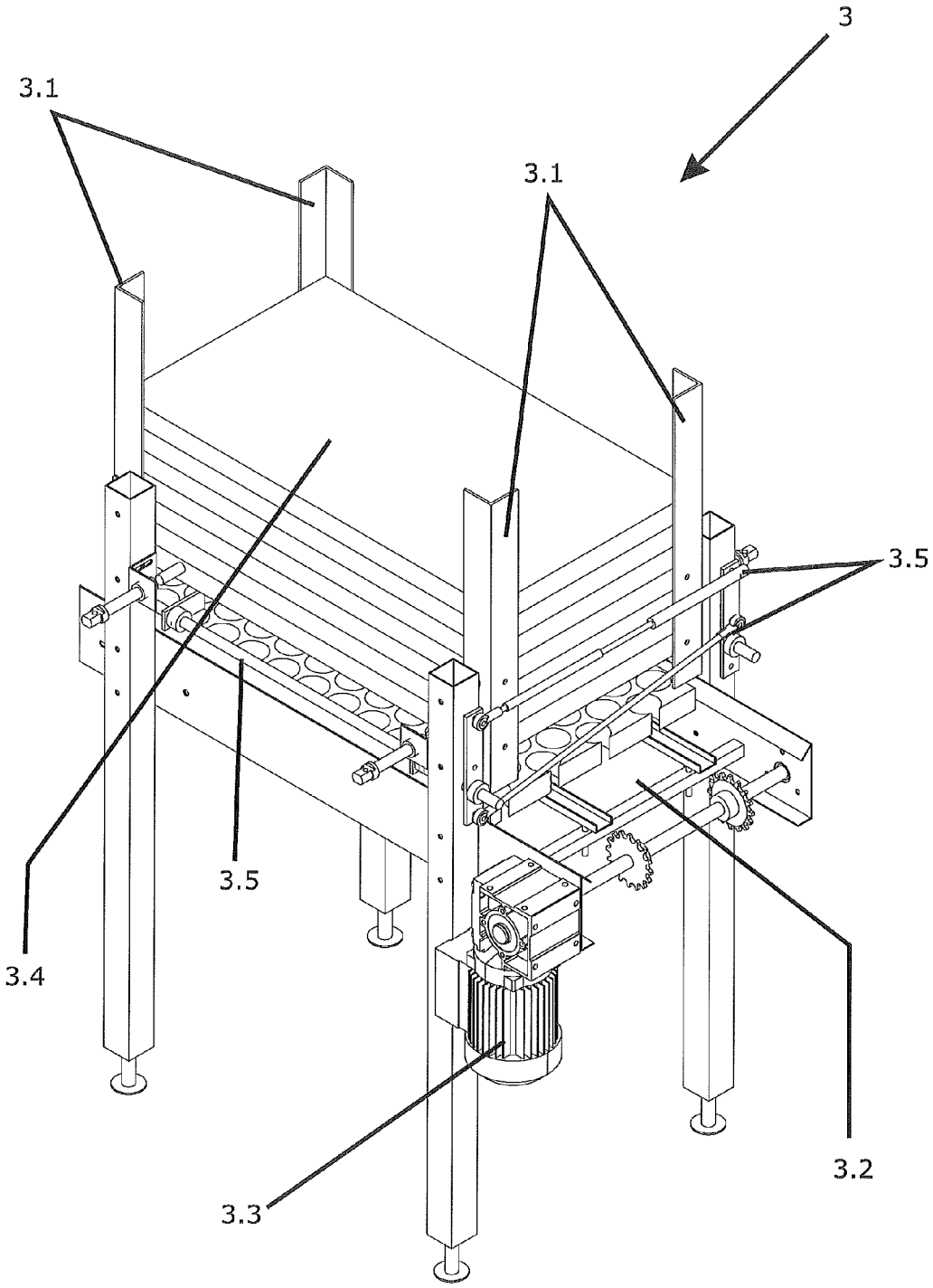
FIG. 7 illustrates an enlarged detail of the intermediary module of the packaging machine for incubator trays, according to the present invention.

The operation of intermediary module (3) is also simple. Several incubator trays are stored one above the other, as best shown in FIG. 6. The tray located immediately on the conveyor belt (3.2) is driven to the lower module (4), according to the timing of the entire packaging machine (1). Since the tray is under the egg receiver structure (2.4), said egg receiver structure (2.4) displaces vertically downwards, the receiver cups (2.41) open axially, and the eggs are then deposited into the cavities of a line of incubator trays (3.4).

The lower module (4) comprises, basically, a large conveyor belt, which is divided into two distinct segments. The first segment (4.1) is located under the upper module (2), while the second segment (4.2) extends from the first segment (4.1).

The first segment (4.1), which is flat, receives the incubator trays (3.4) from the intermediary module (3). In this segment, said incubator trays receive eggs from the cup receiver (2.3) of the upper module (2).

Figure 10:
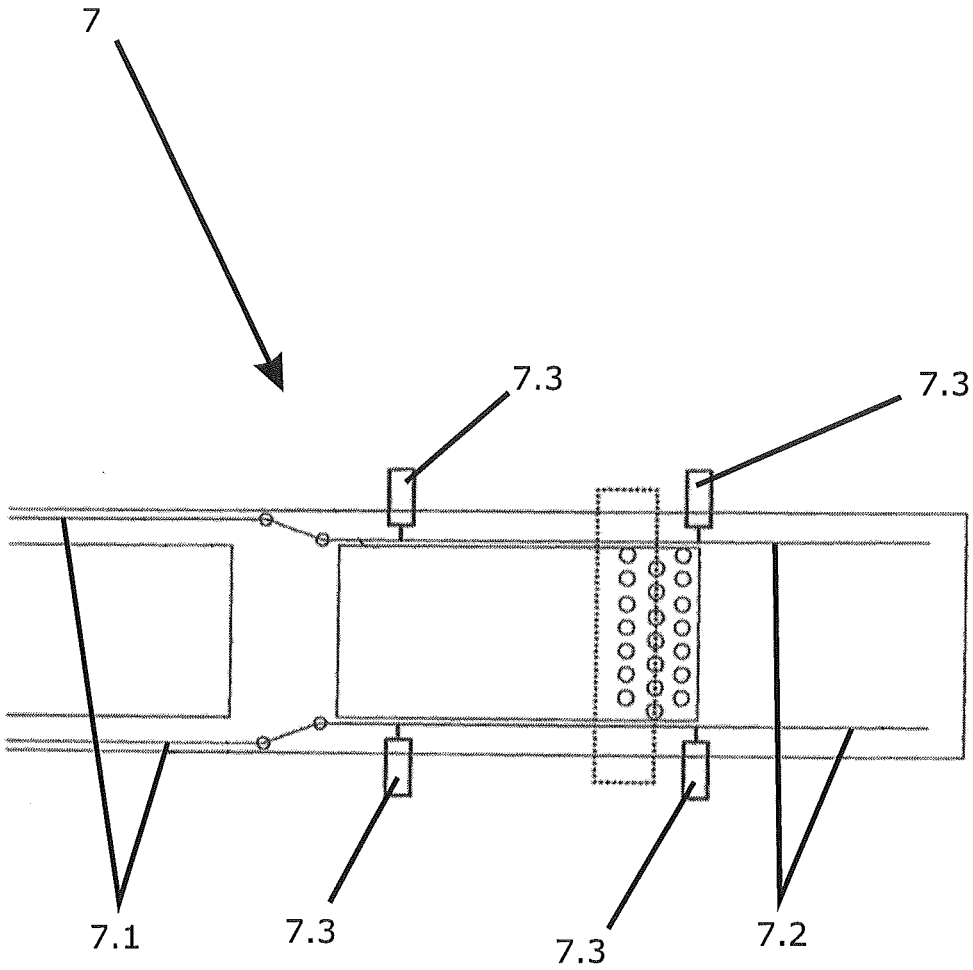
FIG. 10 illustrates a schematic detail of a system of displacement of trays located in the lower module, according to the present invention.

Optionally, the first segment (4.1) also has a tray displacement system, which is responsible for the horizontal displacement of incubator trays, in order to align the direction of egg housings (arranged in rows or columns, generally different each other) in relation to the egg receiver structure (2.4). Consequently, even if an egg tray presents their egg housings arranged in different rows, for example, in a zigzag pattern, problems will not occur during the feeding of said egg housings. This displacement system can be designed by a motor-reduction mechanical system, or by a pneumatic system composed of at least a pneumatic cylinder, which, in this case, said pneumatic cylinder could be placed directly on the side of the tray, or can be placed directly into a joint mechanism, whose function is to move the whole tray. An example of a displacement system can be seen in FIG. 10, where is illustrated a joint mechanism (7) composed of at least fixed side guides (7.1), mobile side guides (7.2) and pneumatic cylinders (7.3).

Since the eggs are properly deposited into cavities of incubator trays (3.4), they proceed to the second segment (4.2), which is substantially tilted. The second segment ends in a platform (4.3). Said platform (4.3) receives the duly filled incubator trays (3.4) and keeps them static, so that an operator can remove them.

It is also important to mention that the entire control and timing systems of the packaging machine (1) are controlled by the control panel (5). Said control panel is an electro-electronic panel provided with at least an electronic board dedicated to the operation and timing of all components that constitute the modules of the packaging machine for incubator trays (1), as well as other basic electrical devices.

The packaging machine (1) of the present invention accepts several arrangements related to the work capacity and may have lines for four, five, six and twelve eggs, wherein said options are related to the incubator trays to be used.

As illustrated in FIGS. 9.1 and 9.2, which illustrate an alternative operating mode of the egg receiver structure (2.4), it is noticeable that, optionally, the receiver cups (2.41) can be independent of each other. In this configuration, said receiver cups (2.41) are assembled into a structure (6) that is composed substantially of two opposing walls (6.1), wherein each wall comprises, in its lower face, grooves (6.2) that act as a rail for their respective receiver cups (2.41). The operation of this optional version is basically similar to the operation of the preferential version, that is, each receiver cup (2.41) receives an egg and moves down, respecting the tapering orientation of its groove (6.2). When each receiver cup (2.41) is at the end of its course end, each one opens and deposits the egg into the right cavity of the incubator tray.

Based on the context described above, it is clear that the construction arrangement introduced in the packaging machine for incubator trays, object of this invention, has an incontestable technical merit associated with inventive step, absolute novelty standard and industrial application.

The invention claimed is:

1. A packaging machine for incubator trays comprising:

an upper module, an intermediary module and a lower module, the lower module having a first segment, the first segment of the lower module having a horizontal tray displacement system, wherein the horizontal tray displacement system horizontally displaces a plurality of incubator trays to align a plurality of egg housings of the plurality of incubator trays with an egg receiver structure of the packaging machine, further wherein the plurality of egg housings are each defined by a first set of rows and a second set of rows, the second set of rows being different than the first set of rows so that when a row of the first set of rows receives eggs from the egg receiver structure, the second set of rows are offline with respect to the egg receiver structure;

wherein the horizontal tray displacement system includes a pneumatic system having a plurality of pneumatic cylinders placed directly into a joint mechanism, the joint mechanism further including at least two fixed side guides, and at least two mobile side guides independently moveable with respect to the first segment of the lower module and each other;

wherein, when at least one of the plurality of pneumatic cylinders is actuated, one of the at least two mobile guide sides is moved in a horizontal direction across the first segment of the lower module to move one of the plurality of incubator trays in a side-to-side motion to align a row of the second set of rows with the egg receiver structure after the row of the first set of rows receives eggs from the egg receiver structure.

2. The packaging machine for incubator trays of claim 1, wherein the movement of one of the plurality of incubator trays across the first segment is in accordance with a timing of the packaging machine.

3. The packaging machine for incubator trays of claim 1, wherein the egg receiver structure includes a plurality of receiver cups, each of the plurality of receiver cups are independent of each other, wherein the plurality of receiver cups are assembled into a structure having two opposing walls, further wherein each of the two opposing walls comprising, in a lower face, a plurality of grooves that act as a rail for the plurality of receiver cups.

4. A packaging machine for incubator trays comprising:

an upper module, an intermediary module, and a lower module, the lower module having a first segment, the first segment of the lower module having a horizontal tray displacement system, wherein the horizontal tray displacement system horizontally displaces an incubator tray of a plurality of incubator trays to align a plurality of egg housings of the incubator tray with an egg receiver structure of the packaging machine, the plurality of egg housings being arranged in rows or columns that are different from each other resulting in an aligned position of a first set of rows or columns with respect to the egg receiver structure, while a second set of rows or columns are in an offline position with respect to the egg receiver structure, wherein the horizontal tray displacement system includes a motor-reduction mechanical system;

wherein the horizontal tray displacement system includes a joint mechanism to move the plurality of incubator trays, the joint mechanism including at least two fixed side guides, and at least two mobile side guides independently moveable with respect to the first segment of the lower module and each other;

wherein, when the motor-reduction mechanical system is actuated, one of the at least two mobile side guide is moved in a horizontal direction across the first segment of the lower module to move the incubator tray of the plurality of incubator trays in a side-to-side motion to align the second set of rows or columns with the egg receiver structure from the offline position.

5. The packaging machine for incubator trays of claim 4, wherein the movement of one of the plurality of incubator trays across the first segment is in accordance with a timing of the packaging machine.

6. The packaging machine for incubator trays of claim 4, wherein the egg receiver structure includes a plurality of receiver cups, each of the plurality of receiver cups are independent of each other, wherein the plurality of receiver cups are assembled into a structure having two opposing walls, further wherein each of the two opposing walls comprising, in a lower face, a plurality of grooves that act as a rail for the plurality of receiver cups.

* * * * *